United States Patent [19]

Demuth et al.

[11] Patent Number: 4,820,350

[45] Date of Patent: Apr. 11, 1989

[54] DEVICE FOR CLEANING AT LEAST ONE SENSOR ROLLER AND METHOD OF CLEANING SUCH SENSOR ROLLER

[75] Inventors: Robert Demuth, Nürensdorf; Anton Wüest, Effretikon, both of Switzerland

[73] Assignee: Maschinenfabrik Rieter AG, Winterthur, Switzerland

[21] Appl. No.: 806,370

[22] Filed: Dec. 5, 1985

[30] Foreign Application Priority Data

Dec. 10, 1984 [CH] Switzerland ..... 05846/84

[51] Int. Cl.[4] ..... B08B 7/00

[52] U.S. Cl. ..... 134/6; 134/18; 73/40; 73/12; 73/104; 73/105; 73/160; 73/32 R; 19/108

[58] Field of Search ..... 134/15, 16, 18; 73/40, 73/12, 104, 105, 160, 32 R; 19/108

[56] References Cited

U.S. PATENT DOCUMENTS 2,536,589 1/1951 Blank .
3,757,569 9/1973 O'Brien et al. ..... 73/104
3,938,223 2/1976 Grice ..... 73/32 R
4,106,333 8/1978 Saljé et al. ..... 73/105
4,359,892 11/1982 Schnell et al. ..... 73/105

FOREIGN PATENT DOCUMENTS 0015121 9/1980 European Pat. Off. .
7912392 4/1979 Fed. Rep. of Germany .

*Primary Examiner*—H. M. S. Sneed
*Assistant Examiner*—Sharon T. Cohen
*Attorney, Agent, or Firm*—Werner W. Kleeman

[57] ABSTRACT

A cleaning device serves for cleaning sensing or sensor rollers which are mutually biased towards each other and between which travels a fiber sliver. Roll cleaning is effected by means of a scraper blade which, in accordance with the invention, is moved intermittently into a scraping position and away therefrom. This provides the advantages of reduced wear on the scraper blade provided at the cleaning device and also reduced wear on the peripheral surface of the associated sensing or sensor roller which is to be cleaned.

14 Claims, 1 Drawing Sheet

DEVICE FOR CLEANING AT LEAST ONE SENSOR ROLLER AND METHOD OF CLEANING SUCH SENSOR ROLLER

BACKGROUND OF THE INVENTION

The present invention relates to a new and improved construction of a cleaning device for cleaning sensing or sensor rollers and also pertains to a new and improved method of cleaning such sensing or sensor rollers with the aid of such cleaning device.

Generally speaking, the inventive cleaning device or apparatus serves for cleaning the sensing or sensor rollers of a sensor roller pair which serve to measure the thickness of a fiber sliver and to produce a signal proportional to such thickness of the fiber sliver. The end faces of these sensor rollers lie in mutually parallel planes and such sensor rollers are appropriately biased towards each other at a variable, mutual spacing. In this cleaning device the fiber sliver runs between the peripheral or circumferential surfaces of the sensor rollers and is thus subjected to a pressure at a predetermined pressure position. Flange-like ring discs or rings on the end faces of the sensor rollers collectively form a groove at the pressure position. For purposes of cleaning these peripheral or circumferential surfaces of the sensor rollers a respective cleaning device or scraper means is provided for each of such sensor rollers.

In British Pat. No. 1,193,437 there have been disclosed rollers by means of which seeds or other foreign materials or contaminants contained in a web of textile fibers are crushed, and thereby the removal of such contaminants or impurities from the web is facilitated. Scraper blades are provided for cleaning of the roller surfaces. These scraper blades continuously engage the peripheral surfaces of the rollers.

British Pat. No. 2,071,723 relates to a scraper arrangement in which a blade engages the associated roller to be scraped due to the weight of the scraper arrangement. The scraper arrangement is liftable away from the roller by rotation about an axis disposed parallel to the roller. The arrangement includes a plurality of pivot plates by means of which, in conjunction with an air cushion, there is achieved adaptation of the blade to unevenness of the roller surface.

The above British Patents relate to rollers which do not have flanges and which do not perform a measuring function.

SUMMARY OF THE INVENTION

Therefore, with the foregoing in mind it is a primary object of the present invention to provide a new and improved construction of a cleaning device for cleaning at least one associated sensing or sensor roller in a manner which is not afflicted with the aforementioned drawbacks and limitations of the prior art constructions.

Another important object of the present invention is directed to the provision of a new and improved construction of a cleaning device for cleaning an associated sensing or sensor roller in a highly efficient, reliable, and protective manner, with reduced wear present at both the circumferential surface of the sensor roller which has been cleaned and the associated scraper blade which has served to clean such sensor roller.

Yet a further significant object of the present invention relates to a new and improved construction of a cleaning device for cleaning an associated sensing or sensor roller in a manner not afflicted with the drawbacks of the prior art heretofore discussed, and which cleaning device is relatively simple in construction and design, highly efficient in its operation, not readily subject to malfunction or breakdown, requires a minimum of maintenance and servicing, and due to the intermittent cleaning operating of the cleaning device both it and the associated sensor roller are subjected to reduced wear.

In contradistinction to the above-mentioned equipment of the prior art herein discussed, the present invention provides means for moving each of the scraper blades intermittently into engagement or contact with the peripheral surface of the associated sensor roller into its scraping position and to retract each of the scraper blades from its scraping position. These means provide the advantage of substantially reduced wear on both the sensing or sensor rollers and the scraper blades. Furthermore, since the scraper blades each become effective for only specifically defined periods, maintenance thereof is less often required.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
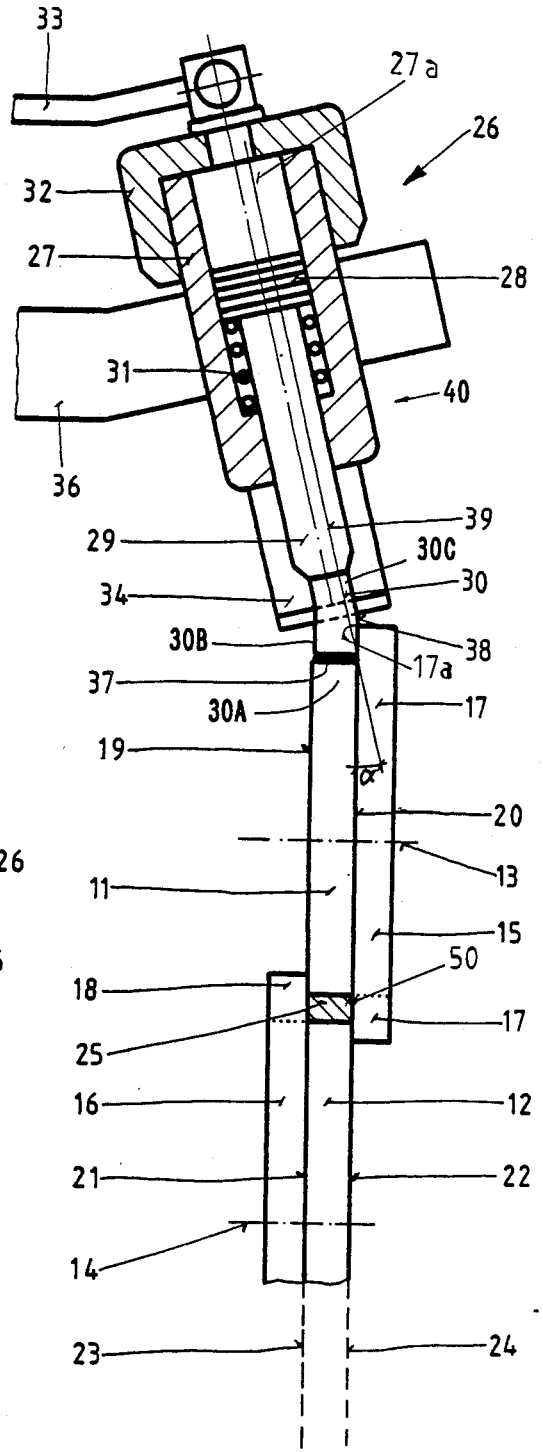
FIG. 1 is a side view of a cleaning device or apparatus constructed according to the present invention.

Describing now the drawings, it is to be understood that to simplify the showing thereof only enough of the structure of the cleaning arrangement for cleaning sensing or sensor rollers has been illustrated therein as is needed to enable one skilled in the art to readily understand the underlying principles and concepts of this invention. Turning attention now specifically to FIG. 1 of the drawings, there has been illustrated therein by way of example and not limitation two sensing or sensor rollers 11 and 12 of a sensing or sensor roller pair 11, 12. Each of these sensor rollers 11 and 12 is rotatable about the related axis 13 and 14, respectively. In the embodiments under discussion each sensor roller 11 and 12 has a respective disc or plate 15 and 16 secured thereto. The radius of each such disc 15 and 16 is larger than that of the associated sensor rollers 11 and 12. Thus, each sensor roller 11 and 12 is provided along its periphery or circumference with a respective flange-like annular disc portion or ring 17 and 18, the width of which is indicated by dotted lines. The side or end faces 19 and 20 of the sensor roller 11, and the side or end faces 21 and 22 of the other sensor roller 12 lie in two mutually parallel planes 23 and 24. A fiber sliver 25 travels through the described arrangement between the sensor rollers 11 and 12.

A cleaning device or scraper means or structure 26 serves for cleaning the sensor roller 11. A similar cleaning device or scraper means or structure is provided for cleaning the other sensor roller 12, but such has not been particularly shown for reasons of preserving clarity in the presentation of the drawings, and particularly since such further cleaning device is identical to the cleaning device 26 illustrated in the drawings. It therefore will suffice to describe such illustrated cleaning device or scraper means or structure 26 and the comments made with reference thereto are to be understood as applicable to the other non-illustrated cleaning device or scraper structure 26.

It will be observed that the depicted cleaning device or scraper means or structure 26 comprises moving means 40 containing a drive cylinder 27 provided with a piston 28 moveable therein and a piston rod 29, defining a blade carrier or carrier means, connected with the moveable piston 28. The piston rod 29 carries a scraper blade 30 which is appropriately secured thereto. This scraper blade 30 has the form of an elongated flat plate and has an end portion 30A which is remote from the moving means 40.

Figure 2:
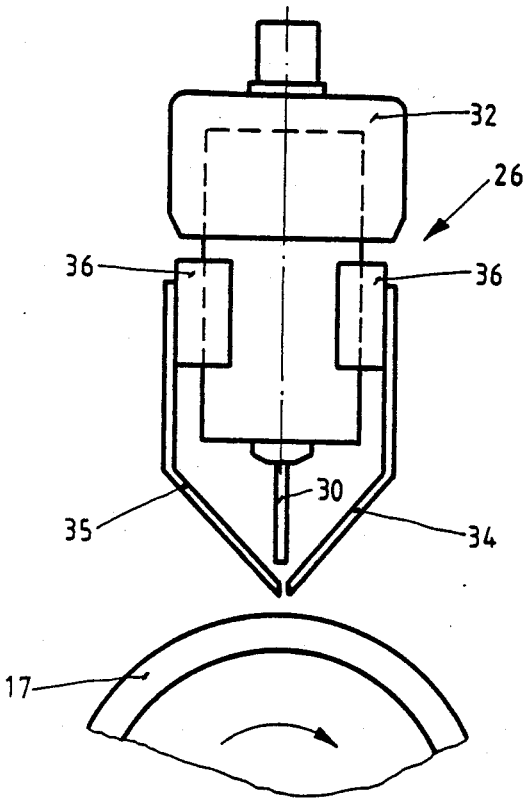
FIG. 2 is a view of the cleaning device and its associated scraper blade illustrated in FIG. 1 and viewed in the direction of the arrow II thereof.

The scraper blade 30 has been shown in FIG. 1 in its scraping position and in FIG. 2 in a position spaced or remote from such scraping position. It can be seen from FIG. 1 that the end portion 30A of the scraper blade 30, when in its scraping position, engages the peripheral or circumferential surface of the related sensor roller 11 and also engages at the side wall 17*a* of the associated flange-like annular disc portion or ring 17 located on the side of this sensor roller 11. Furthermore, a return spring 31 is provided for the piston 28. Above the drive cylinder 27 there is a threaded cover 32 which is secured in position by appropriate screw threads. A line or conduit 33 serves for the infeed or supply of a suitable pressurized fluid or pressure fluid medium into the interior or cylinder chamber 27*a* of the drive cylinder 27. Finally, support elements 34 and 35 are provided. These support elements 34 and 35 are secured to a holder arrangement or holder means 36 which is particularly provided in order to support the drive cylinder 27.

In operation, the sensing or sensor rollers 11 and 12, which are biased towards each other by not particularly illustrated but conventional biasing means, rotate about their axes 13 and 14 and thereby move the fiber sliver 25 running between them. One of the rollers rotates about a stationary axis, while the second or other roller is moveable in a direction extending substantially at right angles to its axis of rotation. The fiber sliver 25 is confined laterally by the flange-like annular disc portions or rings 17 and 18. The more fibers contained within the fiber sliver 25, that is the higher its density, the less it is compressed by the sensor rollers 11 and 12, and the further apart the sensing rollers 11 and 12 are moved. The less fibers contained within the fiber sliver 25, the less its density and the closer the approach of the sensing or sensor rollers 11 and 12 under the effect of their bias. By means of the mutual spacing of the sensor rollers 11 and 12, the thickness of the fiber sliver 25 is therefore measured and an appropriate signal, dependent upon such measured thickness, is generated by non-illustrated conventional means as is well known in this technology. These means can, for example, be used to control the fiber feed in order to even out the fiber sliver 25. The means used for these procedures are not illustrated in the drawings, particularly since they have no direct relevance to the present invention and do not constitute part of the subject matter thereof.

During operation of the described arrangement, contamination or soiling of the peripheral surfaces of the sensor rollers 11 and 12 is caused by the moving fiber sliver 25. For cleaning of these sensor rollers, there is provided, for instance, the cleaning device or scraper means or structure 26 for the sensor roller 11. As will be recalled, a further such cleaning device or scraper means or structure 26 is provided for the other sensor roller 12. The actual cleaning operation is effected by intermittently moving the scraper blade 30 of the scraper means or structure 26 into engagement with the peripheral or circumferential surface of the associated sensor roller 11 and retracting it therefrom. For this purpose, the pressurized or pressure fluid medium is periodically supplied via the line or conduit 33 into the interior or chamber 27*a* of the drive cylinder 27, and thus the piston 28 is moved against the biasing effect of the return spring 31. As a result, the scraper blade 30 is pressed against or towards the peripheral surface of the sensor roller 11 which is thus cleaned. When the pressure of the pressure fluid medium is released, then the return spring 31 moves the scraper blade 30 out of its scraping position. Instead of using the return spring 31, the piston 28 can also be moved back or retracted by pneumatic or hydraulic means.

The groove 50 through which the fiber sliver 25 travels and which is formed by the flange-like annular disc portions or rings 17 and 18, can be so formed or structured that one of the two sensor rollers, for example the sensor roller 11, has a flange-like disc or flange-like annular disc portion on each of its side or end faces 19 and 20 while the other sensor roller 12 has no such discs. In this case, for cleaning purposes, the scraper blade must be brought into engagement with the peripheral surface of the roller having the two flange-like discs by performing a movement essentially parallel to the side or end faces of the sensor roller. If the side walls of the groove are also to be cleaned, the scraper must have a quadrilateral or rectangular form, so that when it penetrates into the groove both the peripheral roll surface which is to be cleaned and also the inner side walls of the groove are simultaneously cleaned.

However, in the embodiment illustrated in FIG. 1, the one disc 15 is mounted on the side or end face 20 of the sensor roller 11 and the other disc 16 is mounted on the side or end face 21 of the other sensor roller 12 in order to form the groove 50 for the through passage of the fiber sliver 25. For cleaning the side walls of the flange-like disc portions or rings 17 and 18, which lie laterally of the sensor rollers 11 and 12, in accordance with the embodiment illustrated in FIG. 1, the arrangement of the cleaning device or scraper means or structure 26 has an inclined disposition in which the axis of the piston rod 29 is disposed at an angle $\alpha$ with reference to the planes 23 and 24.

As shown in FIG. 1, the scraper blade 30 is also advantageously provided with a bent or angled configuration at this angle $\alpha$. This embodiment has the advantage that when the scraper blade 30 engages the peripheral surface of the sensor roller 11, such scraper blade 30 can also be simultaneously, that is to say in a single movement, brought into engagement with the side wall 17*a* of the flange-like annular disc portion or ring 17 which is located laterally of the sensor roller 11, and thus these two surfaces can be simultaneously cleaned. The two edges 37 and 38 of the scraper blade 30, which are in respective engagement in this case with the peripheral surface of the sensor roller 11 and the side wall 17*a* of the flange-like annular disc portion or ring 17, form a right angle with one another as has been shown in FIG.

1. It will be apparent that generally the bending or flexing through the angle $\alpha$ must be carried out in such a manner that the axis of the piston rod 29 is oriented essentially parallel to a straight line 39 which passes through the intersection of the scraper edges 37 and 38 which are disposed at right angles to each other and which straight line 39 bisects or subdivides the right angle formed by these scraper edges 37 and 38. The same also applies for the bent portion of the scraper blade 30 and the edge portions 30B and 30C which extend from the edge 37 and are bent at a predetermined spacing therefrom.

The angle $\alpha$, which the straight line 39 forms with the planes 23 and 24, can lie in the range of 5° to 30°. This applies also for the bent portion of the scraper blade 30.

The arrangement including the bent or flexed portion is not used in the previously described embodiment in which the two discs or plates 15 and 16 are provided on the same sensor roller, because in that embodiment the scraper blade must be moved into engagement in a direction parallel to the parallel planes 23 and 24. The arrangement with the bend is, however, advantageous in combination with the embodiment of FIG. 1 where respective discs 15 and 16 are mounted on respective sensor rollers 11 and 12, because in accordance therewith, as a result of the inclined movement of the scraper blade 30 into its scraper position, there is achieved an effective and positive simultaneous cleaning of the peripheral surface of the sensor roller and of the side wall of the flange-like annular disc portion or ring with a construction requiring less precision. In particular, in this case it is not necessary to provide the relatively high precision of the blade width which must be ensured for the embodiment in which both flange-like discs or flange-like annular disc portions are located on the same sensor roller.

During the movement of the scraper blade 30 into its scraping position as has been illustrated in FIG. 1, this scraper blade 30 is inserted between the free front ends of the support elements or supports 34 and 35. The intervening or intermediate space between the free front ends of these support elements 34 and 35 is somewhat less than the thickness of the scraper blade 30 when such scraper blade 30 is retracted, as illustrated in FIG. 2. In order to permit the required blade insertion, at least one of these support elements is made resiliently or elastically bendable. In the example illustrated in FIG. 2, this is the case for the support element 35. The other support element 34 is made of a rigid material and thus in particular performs a support function while taking into account the direction of rotation of the sensor roller 11 with the flange-like annular disc portion or ring 17 as indicated by the arrow in FIG. 2.

Upon each retraction or withdrawal of the scraper element 30, dirt or any other contaminants or impurities adhering thereto are scraped off by the action of the support elements 34 and 35. The resulting impurities can be removed by any suitable means. Thus, there is obtained the additional advantage of self-cleaning of the scraper element 30 through the provision of the support elements 34 and 35.

The removal of the contaminants or impurities creates no difficulties because only small quantities result from the individual cleaning operations or movements. It it is necessary to prevent these impurities from falling or dropping into an undesired position, then they can be removed by any suitable means, for example by suction. However, an arrangement can also be used, for example, in which the side faces of the sensor rollers are arranged horizontally. In this case, the impurities can fall into the ground without disadvantage.

In another embodiment, in wich the sensor rollers 11 and 12 are also arranged vertically above each other, the cleaning devices or scrapers 26 are mounted horizontally, whereby the scraper blades 30 come into engagement in a laterally disposed region of the peripheral surfaces of the sensor rollers 11 and 12. In this arrangement, there is the additional advantage that the pressure of the cleaning device or scraper structure 26 has practically no influence upon the position of the moveable sensor roller and thus upon the thickness measurement for the fiber sliver.

The provision of the piston 28, moveable in its associated drive cylinder 27, together with the return spring 31 is also particularly advantageous because of the simplicity of the equipment and control thereof.

Referring to FIG. 2, the thickness of the scraper blade 30 can be, for example, 0.5 millimeters. In this case, the dimension of the intervening space between the free ends of the support elements 34 and 35 can lie between 0.1 mm and 0.4 mm.

With reference to the intermittent movement of the scraper blade 30 into the aforedescribed engagement or contact with the associated sensor roller 11 and the flange-like annular disc portion or ring 17, it has been found that an operating cycle has provided suitable in which periods of from 5–30 minutes in the rest position are provided between successive cleaning intervals of from 5–20 seconds, preferably 10 seconds. Thus, the relationship of the length of the cleaning intervals of the scraper blade to the length of the intervals in the rest position thereof lie between 1:15 and 1:360. From this data it can be seen in an impressive manner that the wear is substantially smaller than with known equipment where the scraper blade is in continual engagement.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A sensor roller cleaning arrangement comprising:

a sensor roller pair which serve to measure the thickness of a fiber sliver and to produce a signal proportional to the measured thickness thereof;

each of the sensor rollers of said sensor roller pair having a respective end face and a respective peripheral surface;

said end faces lying in mutually parallel planes;

said sensor rollers of said sensor roller pair being spaced from each other such that the fiber sliver travelling between the peripheral surfaces of the sensor rollers is subjected to a pressure at a pressure position;

flange-like disc portions provided on the end faces of the sensor rollers of said sensor roller pair and which flange-like disc portions collectively form a groove at such pressure position;

at least one cleaning device operatively associated with said sensor roller pair for cleaning at least one sensor roller of said sensor roller pair;

said at least one cleaning device containing at least one scraper means for scraping at least said peripheral surface of said at least one sensor roller;

said at least one cleaning device further containing at least one moving means drivingly connected to said at least one scraper means for alternatingly placing said at least one scraper means into and out of a scraping position at least at said peripheral surface of said at least one sensor roller;

at least said peripheral surface of said at least one sensor roller being placed by said at least one moving means into scraping contact with said at least one scraper means during a first period of time and out of scraping contact with said at least one scraper means during a second period of time so that at least said peripheral surface is only scraped and thus cleaned during said first period of time; and said first period of time being shorter than said second period of time.

2. The sensor roller cleaning arrangement as defined in claim 1, wherein:

a first one of the flange-like disc portions is provided at a first sensor roller of the sensor roller pair at said end face of said first sensor roller;

a second one of said flange-like disc portions being provided at a second sensor roller of said sensor roller pair at said end face of said second sensor roller and which end face is located remote from said end face of said first sensor roller;

said at least one scraper means comprising a scraper blade which scrapes the peripheral surface of said at least one sensor roller of said sensor roller pair in said scraping position of said at least one scraper means; and said scraper blade further scraping a side wall of the associated flange-like disc portion and located laterally of said at least one scraper means in said scraping position of said at least one scraper means.

3. The sensor roller cleaning arrangement as defined in claim 2, wherein:

said scraper blade comprises a substantially flat plate having an end portion remote from said moving means;

said moving means including carrier means for supporting said substantially flat plate of said scraper blade;

said end portion of the flat plate having two scraper edges disposed at substantially right angles to each other; and one of said two scraper edges scraping said peripheral surface of said at least one sensor roller and an other one of said two scraper edges scraping the side wall of the associated flange-like disc portion in the scraping position of said at least one scraper means.

4. The sensor roller cleaning arrangement as defined in claim 3, wherein:

said carrier means comprises a rod moveable in a direction along its longitudinal axis and arranged at an inclination with respect to the associated sensor roller; and said rod being disposed in a position which is essentially parallel to a straight line which passes through an intersection of said two scraper edges which are disposed at right angles to each other and which straight line subdivides said right angle.

5. The sensor roller cleaning arrangement as defined in claim 4, wherein:

said scraper blade has a bent configuration;

said scraper blade having two edge portions disposed at right angles to one of said two scraper edges which are disposed at a right angle to each other;

said two edge portions being bent at a predetermined spacing from said one scraper edge, in order to extend substantially parallel to said straight line which passes through the intersection of said two scraper edges disposed at right angles to each other and which straight line subdivides said right angle.

6. The sensor roller cleaning arrangement as defined in claim 3, further including:

support elements cooperating with said scraper blade;

the end portion of the scraper blade, during its movement under the action of said moving means, being passed between said support elements;

said support elements extending towards each other in the direction of the movement of said scraper blade;

at least one of the support elements being formed to be resiliently deformable; and said support elements having ends directed towards each other and which ends have a mutual spacing which is less than the thickness of the scraper blade.

7. The sensor roller cleaning arrangement as defined in claim 4, wherein:

said carrier means comprises a piston rod;

said moving means comprising a piston and a drive cylinder cooperating with said piston rod; and said piston being moveable in said drive cylinder and serving for moving said piston rod.

8. The sensor roller cleaning arrangement as defined in claim 7, wherein:

said piston serves to pneumatically move said scraper blade into said scraping position; and a return spring for biasing said piston in a direction in which the retracting movement of the scraper blade from the scraping position is carried out.

9. The sensor roller cleaning arrangement as defined in claim 1, wherein:

said sensor rollers being arranged essentially vertically above each other;

said scraper means contacting the peripheral surface of said at least one sensor roller in a laterally disposed position of said peripheral surface relative to said at least one cleaning device.

10. The sensor roller cleaning arrangement as defined in claim 4, wherein:

said straight line forms a predetermined angle with said mutually parallel planes defined by said end faces of said sensor roller pair; and said predetermined angle lying between 5° and 30°.

11. The sensor roller cleaning arrangement as defined in claim 6, wherein:

said scraper blade possesses a thickness which is approximately 0.5 mm; and said mutual spacing between said ends of the support elements directed towards each other lying between 0.1 mm and 0.4 mm when the scraper blade is retracted from between said ends of the support elements.

a return spring for biasing said piston in a direction in which the retracting movement of the scraper blade from the scraping position is carried out.

12. A method of cleaning at least one sensor roller of a sensor roller pair which serve to measure the thickness of a fiber sliver and to produce a signal proportional to the measured thickness thereof, each of the sensor rollers of said sensor roller pair having a respective end face and such end faces lying in mutually parallel planes, said sensor roller pair being biased towards each other at a variable mutual spacing, the fiber sliver traveling between peripheral surfaces of the sensor rollers and thereby being subjected to a pressure at a pressure position, flange-like discs provided on the end faces of the sensor rollers, and which collectively form a groove at the pressure position, scraper means for cleaning the peripheral surface of said at least one sensor roller, and means for moving said scraper means intermittently into engagement with the peripheral surface of said at least one sensor roller in a scraping position of said scraper means and for retracting such scraping means from said scraping position, said method comprising the step of:

controlling the moving means such that the relationship of the period of cleaning intervals of the scraper means to the period of the intervals in a rest position of the scraper means is such that the same lies between 1:15 and 1:360.

13. The sensor roller cleaning arrangement as defined in claim 1, wherein:

said at least one scraper means constituting two scraper means each of which contains a single scraper blade operatively associated with a respective sensor roller of said sensor roller pair.

14. A sensor roller cleaning arrangement comprising:

a sensor roller pair which serve to measure the thickness of a fiber sliver and to produce a signal proportional to the measured thickness thereof;

each one of the sensor rollers of said sensor roller pair having an end face and a peripheral surface;

said end faces lying in mutually parallel planes;

said sensor rollers of said sensor roller pair being spaced from each other such that the fiber sliver travelling between the peripheral surfaces of the sensor rollers is subjected to a pressure at a pressure position;

flange-like disc portions provided on the end faces of the sensor rollers of said sensor roller pair and which flange-like disc portions collectively form a groove at such pressure position;

at least one cleaning device operatively coacting with said sensor roller pair for cleaning at least one sensor roller of said sensor roller pair;

said at least one cleaning device containing at least one scraper means for scraping at least said peripheral surface of said at least one sensor roller;

said at least one cleaning device further containing at least one moving means drivingly connected to said at least one scraper means for alternatingly placing said at least one scraper means into and out of a scraping position at least at said peripheral surface of said at least one sensor roller;

at least said peripheral surface of said at least one sensor roller being in scraping contact with said at least one scraper means during a cleaning interval and out of scraping contact with said at least one scraper means during a rest interval of said at least one scraper means;

said cleaning interval being shorter than said rest interval;

a first one of the flange-like disc portions being provided at a first sensor roller of the sensor roller pair at said end face of said first sensor roller;

a second one of said flange-like disc portions being provided at a second sensor roller of said sensor roller pair at said end face of said second sensor roller and which end face is located remote from said end face of said first sensor roller;

said at least one scraper means comprising a scraper blade which scrapingly contacts the peripheral surface of said at least one sensor roller of said sensor roller pair in said scraping position of said at least one scraper means; and said scraper blade further scrapingly contacting a side wall of the associated flange-like disc portion located laterally of said at least one scraper means in said scraping position of said at least one scraper means.

* * * * *

UNITED STATES PATENT AND TRADEMARK OFFICE

CERTIFICATE OF CORRECTION

PATENT NO. : 4,820,350

DATED : April 11, 1989

INVENTOR(S) : ROBERT DEMUTH et al

It is certified that error appears in the above-identified patent and that said Letters Patent is hereby corrected as shown below:

Column 5, line 65, "It" should read -- If --.

Column 6, line 4, please delete "wich" and insert "which"

Column 8, please delete lines 62, 63 and 64 in their entirety

Signed and Sealed this

Nineteenth Day of December, 1989

*Attest:*

JEFFREY M. SAMUELS

*Attesting Officer* *Acting Commissioner of Patents and Trademarks*